US009803849B2

(12) United States Patent
Yong et al.

(10) Patent No.: US 9,803,849 B2
(45) Date of Patent: Oct. 31, 2017

(54) LAMP RADIATOR AND LED ENERGY SAVING LAMP

(71) Applicant: SHENZHEN YAORONG TECHNOLOGY CO., LTD., Shenzhen, Guangdong (CN)

(72) Inventors: Xing Chun Yong, Guangdong (CN); Huan Huan Yu, Guangdong (CN)

(73) Assignee: SHENZHEN YAORONG TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/438,518

(22) PCT Filed: May 27, 2013

(86) PCT No.: PCT/CN2013/076275
§ 371 (c)(1),
(2) Date: Apr. 24, 2015

(87) PCT Pub. No.: WO2014/063488
PCT Pub. Date: May 1, 2014

(65) Prior Publication Data

US 2015/0285485 A1 Oct. 8, 2015

(30) Foreign Application Priority Data

Oct. 26, 2012 (CN) ..... 2012 1 0421119

(51) Int. Cl.
*F21V 29/71* (2015.01)
*F21S 2/00* (2016.01)
(Continued)

(52) U.S. Cl.
CPC ..... *F21V 29/713* (2015.01); *F21S 2/005* (2013.01); *F21V 23/007* (2013.01);
(Continued)

(58) Field of Classification Search
CPC ..... H01L 21/4871
See application file for complete search history.

(56) References Cited

U.S. PATENT DOCUMENTS 7,798,670 B2 * 9/2010 Kinnune ..... F21V 15/01 362/217.1
2007/0274084 A1 * 11/2007 Kan ..... F21V 5/002 362/373
2009/0314470 A1 * 12/2009 Yang ..... F28D 15/0233 165/104.26

FOREIGN PATENT DOCUMENTS

CN 201293247 Y 8/2009
CN 201302142 Y 9/2009
(Continued)

*Primary Examiner* — Tuan T Dinh
*Assistant Examiner* — Mukund G Patel
(74) *Attorney, Agent, or Firm* — Muncy, Geissler, Olds & Lowe, P.C.

(57) ABSTRACT

The invention discloses a lamp radiator, including a heat conducting plate, wherein the heat conducting plate is fixed together with a fin group for heat dissipation; and a power supply box equipped with a power supply is respectively fixed at the left side and the right side of the heat conducting plate when the lamp radiator is used. The heat conducting plate is an integrated structure which is composed of a base plate and two leg plates; and the cross section of the heat conducting plate is Π-shaped. The length of the fin group for heat dissipation may be changed according to the power of an energy-saving lamp; and the lamp radiator further includes a heat pipe. The invention also discloses an LED energy-saving lamp having the above lamp radiator. When the lamp radiator and the energy-saving lamp according to the invention are used, heat is dissipated upwards through the lamp radiator, so that the service life of the power supply can be prolonged; moreover, the length of the fin group may be changed according to the power of the energy-saving
(Continued)

lamp, and fin groups with different lengths may be produced by only using one set of molds, so that cost is reduced; and in addition, through the design of the heat conducting plate, the fin group, the heat pipe and the like, the heat dispersion performances are good, and the lamp radiator and the LED energy-saving lamp can be widely applied to the illumination field.

9 Claims, 10 Drawing Sheets

(51) Int. Cl.

| | |
|---|---|
| ***F21V 29/74*** | (2015.01) |
| ***F21V 23/02*** | (2006.01) |
| ***F21V 23/00*** | (2015.01) |
| *F21V 29/51* | (2015.01) |
| *F21Y 115/10* | (2016.01) |

(52) U.S. Cl.
CPC ..... *F21V 23/023* (2013.01); *F21V 29/717* (2015.01); *F21V 29/74* (2015.01); *F21V 29/51* (2015.01); *F21Y 2115/10* (2016.08)

(56) References Cited

FOREIGN PATENT DOCUMENTS

| | | | |
|---|---|---|---|
| CN | 201652263 | U | 11/2010 |
| CN | 102900986 | A | 1/2013 |
| CN | 202834943 | U | 3/2013 |

* cited by examiner

LAMP RADIATOR AND LED ENERGY SAVING LAMP

TECHNICAL FIELD OF THE INVENTION

The present invention belongs to the field of radiators, and more particularly relates to a lamp radiator and an LED energy-saving lamp.

BACKGROUND OF THE INVENTION

Energy-saving lamps are usually used as high bay lights, flood lights, spot lights and the like in the market. However, these lamps are neither energy-efficient than an LED lamp, nor have a longer service life than the LED lamp. The LED lamp can work for more than 50,000 h, and can work under a high-speed on-off state, while the energy-saving lamp will become black and will be quickly broken in case of being started or turned off frequently. The LED lamp can be packed in a solid-state, belongs to a cold light source type, is convenient to transport and install, can be installed in any minitype and enclosed device, and cares nothing for vibration. Moreover, the LED lamp is environment-friendly, and has no harmful substances such as mercury and the like.

Although the LED lamps with tenable leak tightness are used as the high bay lights, flood lights, spot lights and the like presently, the service life of the power supply is generally short, and the heat dissipation performances are poor.

FIG. 1 is a structure schematic view of a present energy-saving lamp. FIG. 2 is a structure schematic view of a radiator of the present energy-saving lamp. The radiator 1-1 is a cylindrical structure and the cross section thereof is sunflower-shaped. A power supply box 1-2 of the energy-saving lamp is installed on the top of the radiator 1-1; in this way, heat is dissipated through the radiator 1-1 when the energy-saving lamp is working. Since the power supply box 1-2 at the top of the radiator 1-1 is unceasingly heated by rising hot air, the temperature of the power supply is increased, which affects and shortens the service life of the power supply.

Moreover, the present energy-saving lamp cannot dissipate heat outwards as soon as possible, and the heat dissipation performances thereof are poor.

Furthermore, if the power of the energy-saving lamp is changed, the size of the radiator in the cylindrical structure with a sunflower-shaped cross section needs to be changed, and a module needs to be manufactured in each time when the size of the radiator is changed, which causes a higher cost.

SUMMARY OF THE INVENTION

The inventors have conducted multiple tests and analysis, and consider that when the power supply box of the energy-saving lamp is installed at the top of the radiator, the heat is dissipated through the radiator when the energy-saving lamp is working; due to heat expansion and cold contraction, the heated air is expanded and the density thereof is decreased, so that the hot air is lighter than common air; therefore, the hot air is rising and unceasingly heating the power supply box at the top of the radiator, which increases the temperature of the power supply, affects and shortens the service life of the power supply. Moreover, the heat cannot be dissipated outwards as soon as possible, and the heat dissipation performances are poor. Moreover, when the power of the energy-saving lamp is changed, the size of the sunflower-shaped radiator needs to be changed, which causes a high mould cost.

With regard to the above-mentioned defects, the object of the present invention is to provide a lamp radiator which can prolong the service life of a power supply of an energy-saving lamp and make the energy-saving lamp have better heat dissipation performances, and can effectively solve the problems of the energy-saving lamp in the related art such as short service life of the power supply, poor heat dissipation performances and high mould cost.

Another object of the present invention is to provide an LED energy-saving lamp, which has the lamp radiator that prolongs the service life of the power supply thereof, and implements better heat dissipation performances and low mould cost. The LED energy-saving lamp may be an LED high bay light, an LED flood light, an LED spot light, and the like.

To solve the foregoing technical problems, the inventors propose the following technical solutions.

A lamp radiator includes a heat conducting plate. The heat conducting plate is fixed together with a fin group for heat dissipation, and a power supply box equipped with a power supply is respectively fixed at the left side and the right side of the heat conducting plate when the lamp radiator is used (the two power supply boxes equipped with the power supplies are external parts, i.e., parts of such energy-saving lamp as a high bay light, a flood light, a spot light, and the like, rather than the parts of the lamp radiator).

Preferably, the heat conducting plate is an integrated structure which is composed of a base plate and two leg plates; and the cross section of the heat conducting plate is Π-shaped.

Preferably, the length of the fin group for heat dissipation may be changed according to the power of an energy-saving lamp, and may be designed flexibly, and lamp radiators with different sizes may be manufactured by increasing or decreasing the number of fins.

Preferably, the fin group for heat dissipation is composed of X fins in a fastening manner, wherein X is no less than 3 and is a natural number; each fin is a square; a bending platform is respectively arranged on the length direction and the width direction of the fin, and the fin group for heat dissipation composed in a fastening manner forms a bending plane respectively on the length direction and the width direction of the fin.

Preferably, two fin groups for heat dissipation are provided, wherein the bending planes of each fin group for heat dissipation are welded and fixed on the external side of the leg plate and the base plate of the heat conducting plate.

Preferably, the lamp radiator further includes a heat pipe, and the internal sides of the two leg plates of the heat conducting plate are respectively provided with N raised grooves, wherein the inner walls of M raised grooves of each leg plate of the heat conducting plate are tightly contacted with the heat pipe; M is less than N, and M and N are natural numbers.

Preferably, the heat pipe is hollow and the two ends thereof are smaller than the middle; and the heat pipe is connected with the inner walls of the raised grooves via welding or interference fit.

Preferably, each of the M raised grooves is equipped with two heat pipes, wherein one end of one heat pipe is located at one end of the raised groove and the other end of the heat pipe is located close to the neutral position of the raised groove; one end of the other heat pipe is located at the other end of the raised groove, and the other end of the heat pipe is located close to the neutral position of the raised groove.

Preferably, the power supply boxes equipped with the power supplies are fixed at the left side and the right side of the heat conducting plate through fastening pieces and the raised grooves of the heat conducting plate, wherein the heat conducting plate is made of aluminum or copper, and the heat pipe is made of such metal products like copper or aluminum or stainless steel, which can quicken the heat dissipation.

AN LED energy-saving lamp includes the foregoing lamp radiator as well as the power supply boxes respectively fixed at the left side and the right side of the heat conducting plate and equipped with the power supplies. The LED energy-saving lamp may be an LED high bay light, an LED flood light, an LED spot light, and the like.

Compared with the related art, the present invention has the following advantageous effects.

1) In the lamp radiator according to the present invention, one external power supply box equipped with the power supply may be respectively fixed at the left side and the right side of the heat conducting plate; in this way, when the energy-saving lamp is working, the heat is dissipated upwards through the lamp radiator; this structure can keep excellent ventilation of the lamp radiator, less heat the external power supply boxes equipped with the power supplies at the left side and the right side, make the power supply boxes be less disturbed by the hot air, and can prolong the service life of the power supplies.

2) The length of the fin group for heat dissipation of the lamp radiator according to the present invention may be changed according to the power of an energy-saving lamp, and may be designed flexibly, and lamp radiators with different sizes may be manufactured by increasing or decreasing the number of fins. Lamp radiators may be manufactured by as long as changing the length of the fin group and fin groups having different lengths may be produced using one set of moulds only, which does not need to increase moulds, thus reducing the cost.

3) The lamp radiator and the LED energy-saving lamp according to the present invention may quicken the heat dissipation and have excellent heat dissipation performances through such design as the heat conducting plate, the fin group for heat dissipation, the heat pipe, and the like.

BRIEF DESCRIPTION OF THE DRAWINGS OF THE INVENTION

DETAILED DESCRIPTION OF THE INVENTION

Figure 1:
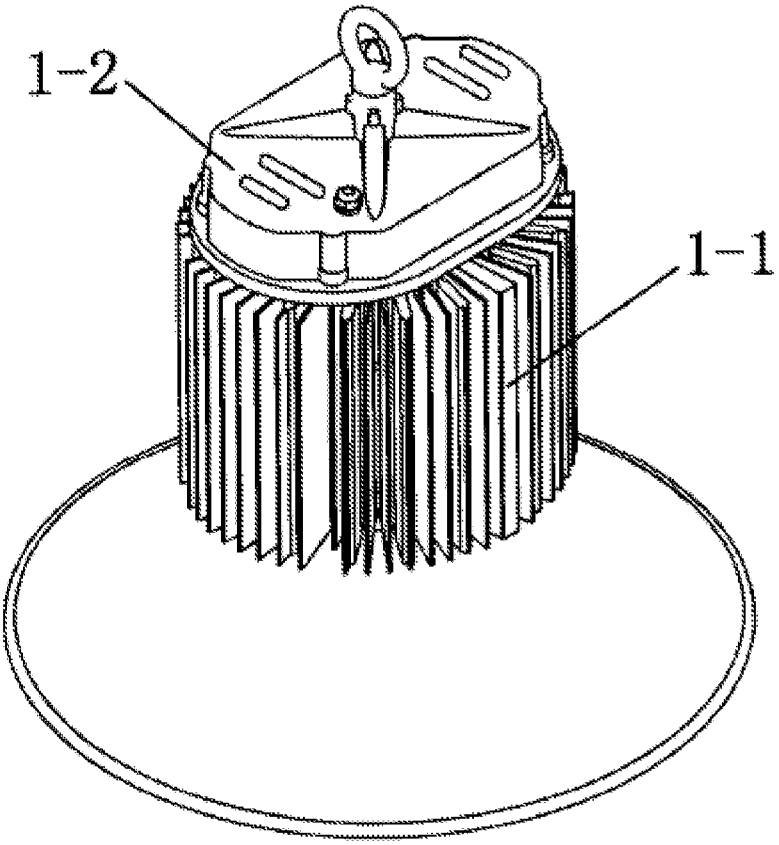
FIG. 1 is a structure schematic view of a present energy-saving lamp.
Figure 2:
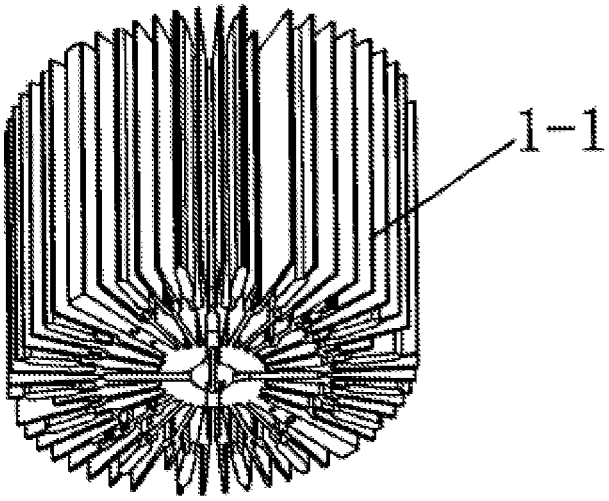
FIG. 2 is a structure schematic view of a radiator of the present energy-saving lamp.
Figure 3:
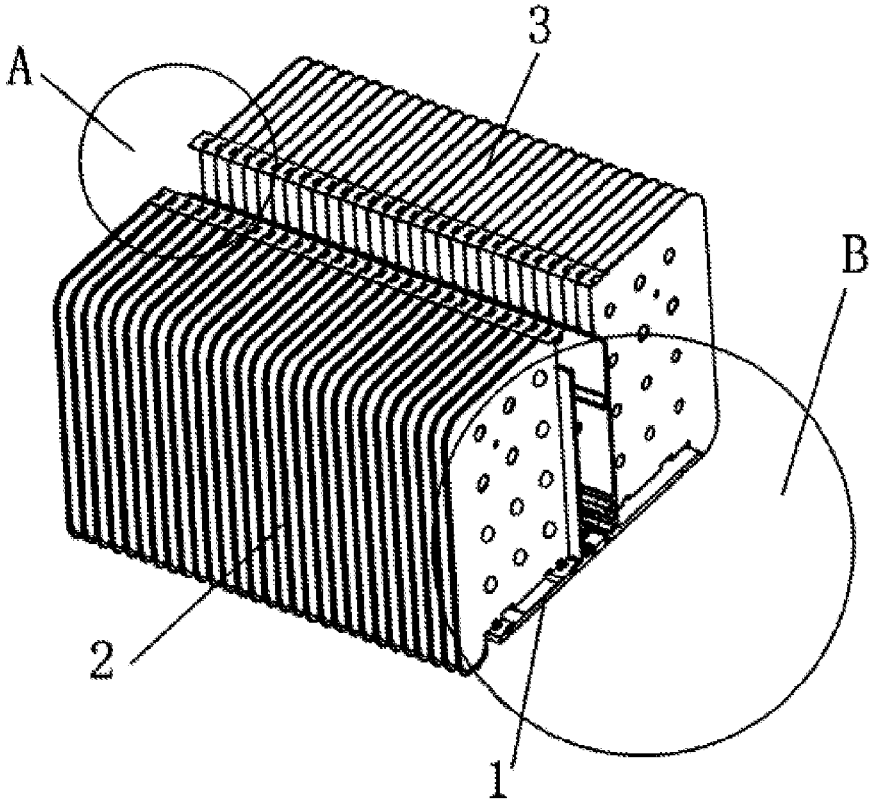
FIG. 3 is a schematic view of one embodiment of a lamp radiator according to the present invention.
Figure 4:
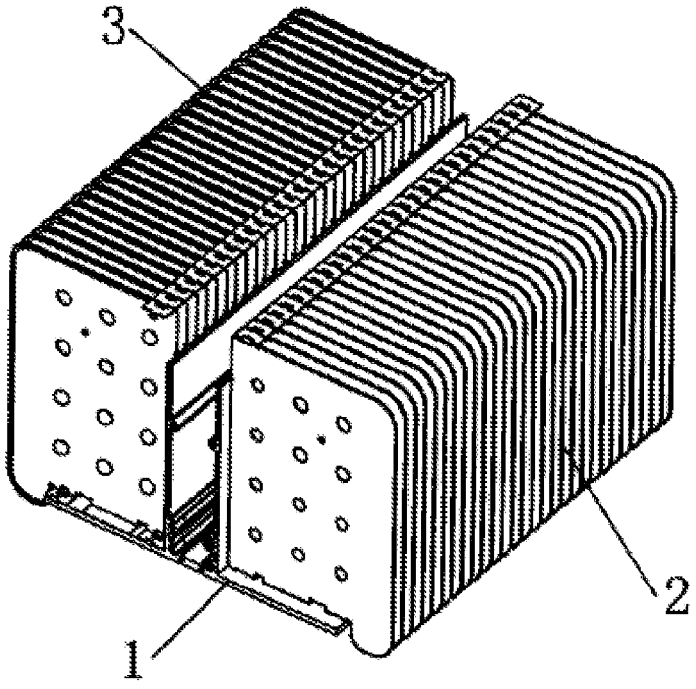
FIG. 4 is another schematic view of FIG. 3.
Figure 5:
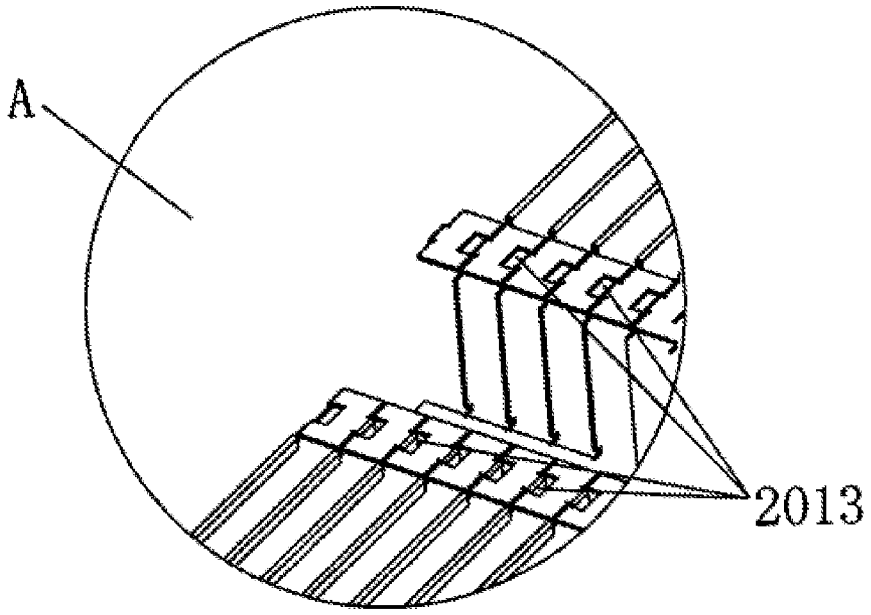
FIG. 5 is an enlarged view of portion A in FIG. 3.
Figure 6:
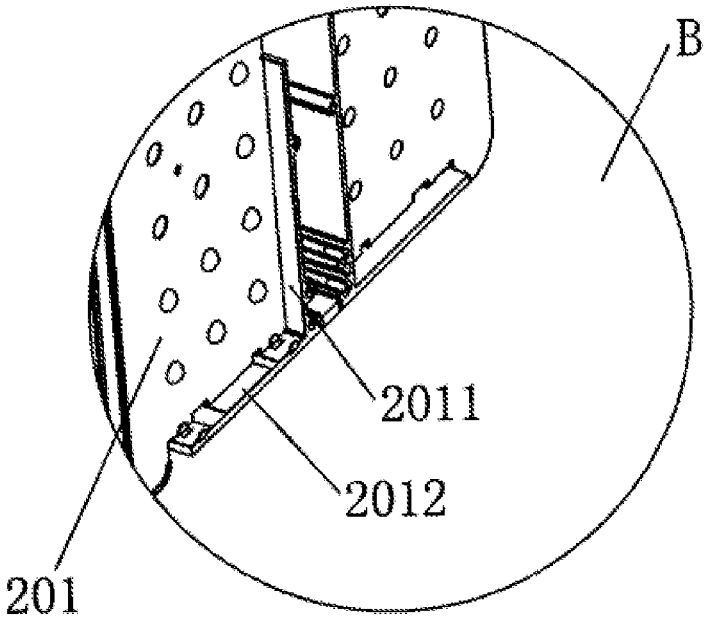
FIG. 6 is an enlarged view of portion B in FIG. 3.
Figure 7:
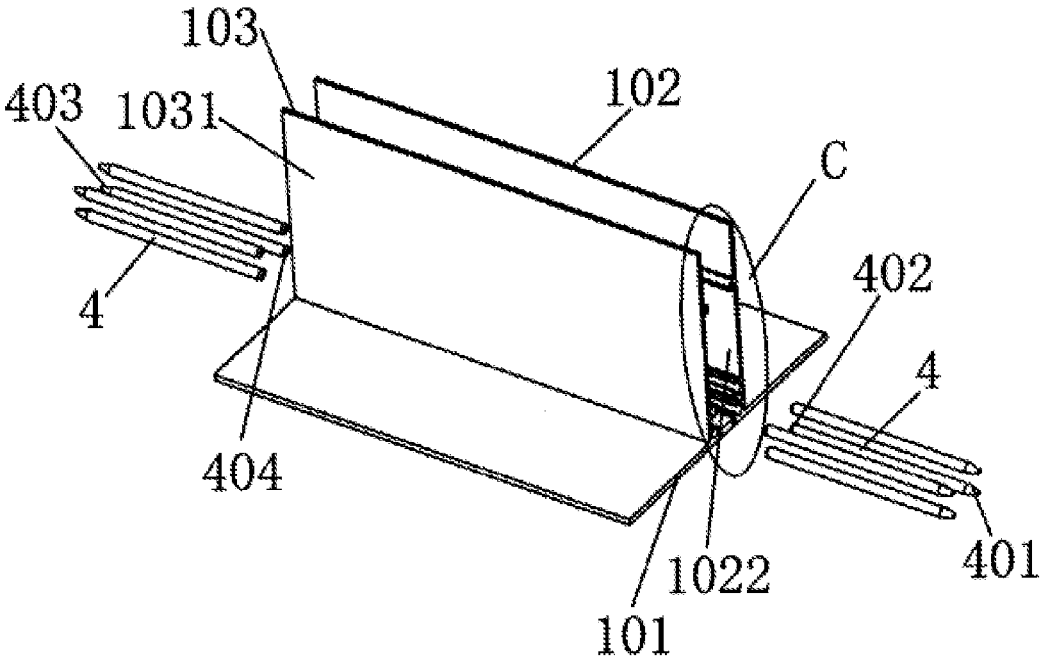
FIG. 7 is a schematic view of a heat conducting plate and a heat pipe of the lamp radiator according to the present invention.
Figure 8:
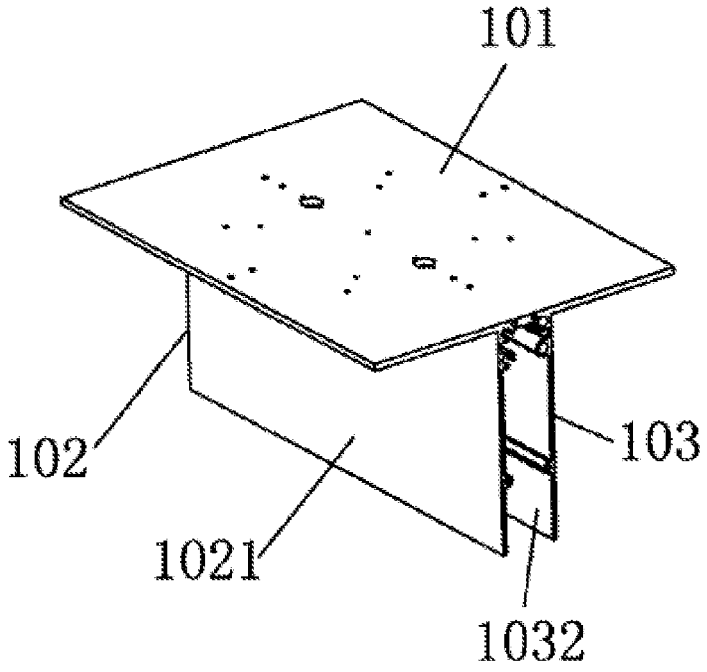
FIG. 8 is a schematic view of the heat conducting plate of the lamp radiator according to the present invention.
Figure 9:
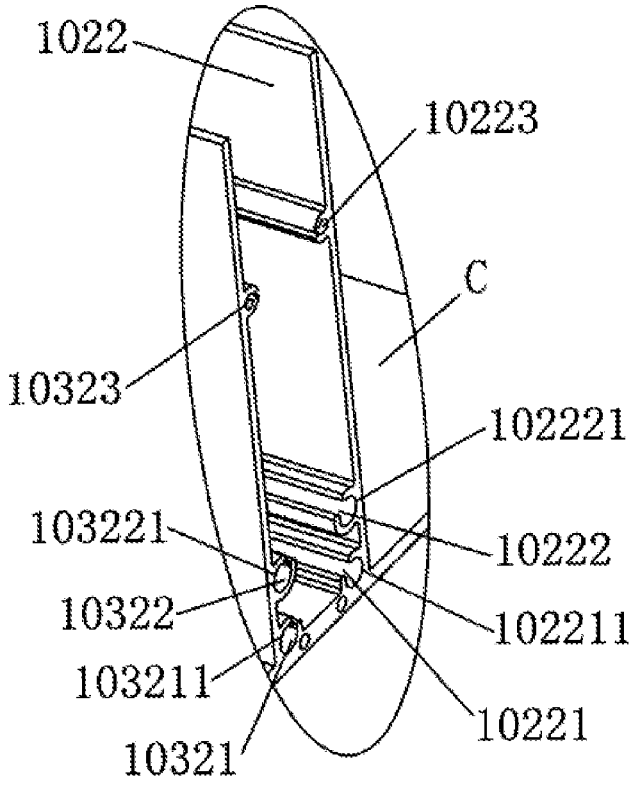
FIG. 9 is an enlarged view of portion C in FIG. 7.
Figure 10:
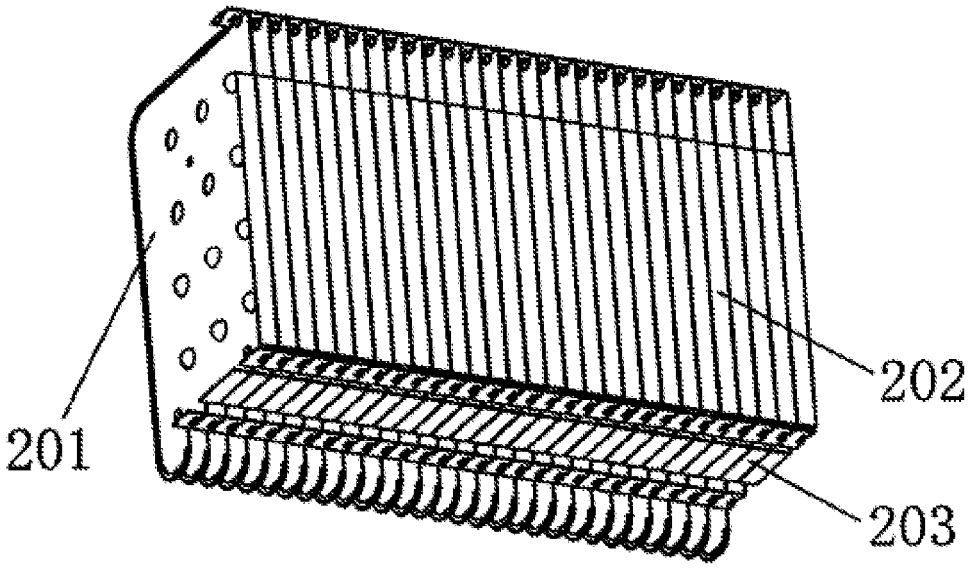
FIG. 10 is a schematic view of a fin group for heat dissipation of the lamp radiator according to the present invention.
Figure 11:
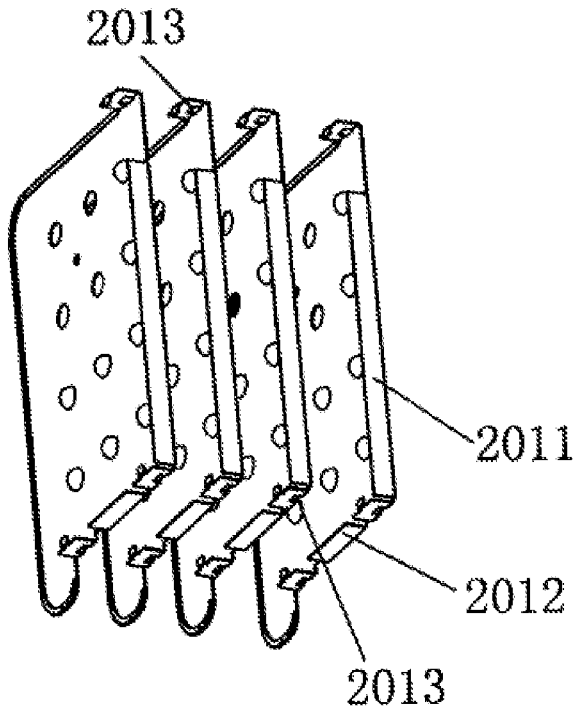
FIG. 11 is an exploded schematic view of four fins of a fin group in FIG. 10.

In order to better understand the present invention, the present invention will be further set forth hereinafter with reference to the accompanying drawings and embodiments.

A lamp radiator according to the present invention includes a heat conducting plate. The heat conducting plate is fixed together with a fin group for heat dissipation; and a power supply box equipped with a power supply is respectively fixed at the left side and the right side of the heat conducting plate when the lamp radiator is used. Since one external power supply box equipped with the power supply may be respectively fixed at the left side and the right side of the heat conducting plate of the lamp radiator according to the present invention; in this way, when the LED energy-saving lamp is working, the heat is dissipated upwards through the lamp radiator; this structure can keep excellent ventilation of the lamp radiator, less heat the external power supply boxes equipped with the power supplies at the left side and the right side, make the power supply boxes be less disturbed by the hot air, and can increase the service life of the power supplies.

Multiple fin groups for heat dissipation may be arranged, and two fin groups for heat dissipation are taken as an example hereinafter.

Please refer to FIG. 1 to FIG. 19. The lamp radiator according to the present invention includes a heat conducting plate 1 as well as two fin groups for heat dissipation 2 and 3. The heat conducting plate 1 is an integrated structure which is composed of a base plate 101 and two leg plates 102 and 103; and the cross section of the heat conducting plate 1 may be designed as Π-Shape.

The lengths of the fin groups for heat dissipation 2 and 3 may be changed according to the power of the energy-saving lamp in case of unchanged moulds, and may be designed flexibly. Lamp radiators with different sizes may be manufactured by increasing or decreasing the number of fins, and assembled into energy-saving lamp having different powers. The fin groups for heat dissipation 2 and 3 are composed of 29 fins 201 in a fastening manner (taking X=29 as an example), for instance, through the fastening points 2013 of the fins 201. Each fin 201 is a square. A bending platform 2011 and a bending platform 2012 are respectively arranged on the length direction and the width direction of the fin 201, and the fin groups for heat dissipation 2 and 3 composed in a fastening manner form a bending plane 202 and a bending plane 203 respectively on the length direction and the width direction of the fin 201. The bending plane 202 is welded and fixed on the external side 1021 of the leg plate and the base plate 101 of the heat conducting plate, and the bending plane 203 is welded and fixed on the external side 1031 of the leg plate and the base plate 101 of the heat conducting plate, which facilitate the heat conduction. Such metal solders like solder paste or other compound solders may be used as a solder.

To quicken the heat dissipation, the lamp radiator further includes a heat pipe 4. The internal sides 1022 and 1032 of the two leg plates of the heat conducting plate are respectively provided with three raised grooves 10221, 10222 and 10223 as well as 10321, 10322 and 10323 (taking three raised grooves for example), wherein the inner walls 102211 and 102221 as well as 103211 and 103221 of the two raised grooves of each leg plate of the heat conducting plate (taking two raised grooves for example) of each of M raised grooves of each leg plate of the heat conducting plate are tightly contacted with the heat pipe 4. The heat pipe 4 may be designed to be hollow and the two ends thereof are smaller than the middle. The heat pipe 4 is connected with the inner walls 102211, 102221, 103211 and 103221 of the raised grooves via welding or interference fit. Each of the two raised grooves 10221 and 10222 as well as 10321 and 10322 of the heat conducting plate is equipped with two heat pipes 4, wherein one end 401 of one heat pipe is located at one end of the raised groove 10221 (taking the raised groove 10221 for example) and the other end 402 of the heat pipe is located close to the neutral position of the raised groove 10221; one end 403 of the other heat pipe is located at the other end of the raised groove 10221, and the other end 404 of the heat pipe is located close to the neutral position of the raised groove 10221. In this way, the heat pipes 4 will conduct the heat of a middle heat source of the lamp radiator to the two ends to quicken the heat dissipation. The cross section of the heat pipe 4 may be round, square or ellipse, and the raised grooves tightly contacted thereof are also designed into the shapes matched with the heat pipe 4.

The power supply boxes 5 and 6 equipped with the power supplies are fixed at the left side and the right side 104 and 105 of the heat conducting plate through fastening pieces and the raised grooves 10223 and 10323 of the heat conducting plate, which are beneficial for keeping excellent ventilation. The power supply boxes equipped with the power supplies are less heated by the hot air, which may prolong the service life of the power supplies.

Furthermore, to quicken the heat dissipation, the heat conducting plate 1 may be made of aluminum or copper, and the heat pipe 4 may be made of such metal products as copper or aluminum or stainless steel, and the like.

Only some examples are listed above, and the number of the raised grooves, the number of the heat pipes, the number of the fins, and the like may be designed differently according to specific conditions.

The foregoing lamp radiator may be applied in an LED energy-saving lamp. The LED energy-saving lamp includes the foregoing lamp radiator and the power supply boxes 5 and 6 respectively fixed at the left side and the right side of the heat conducting plate and equipped with the power supplies 7 and 8.

Figure 12:
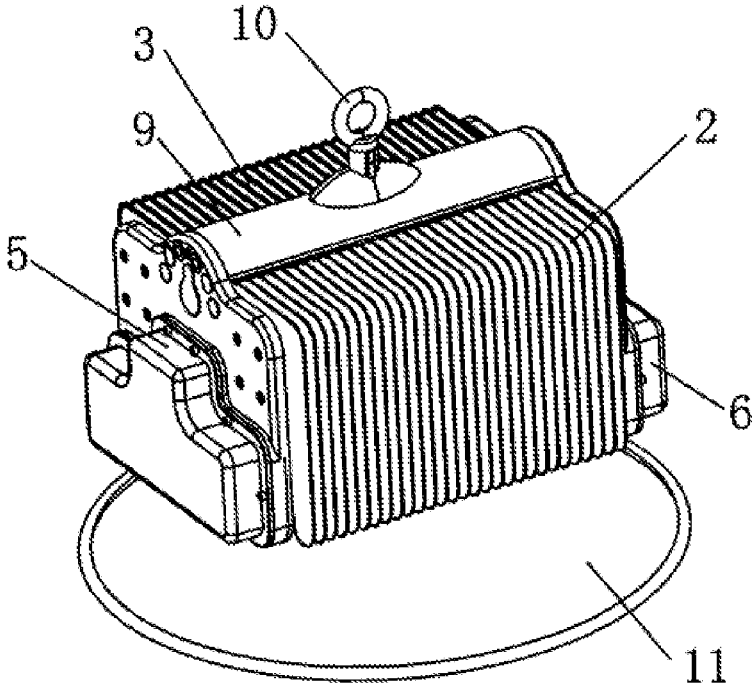
FIG. 12 is a schematic view of a first embodiment of an LED energy-saving lamp according to the present invention.
Figure 13:
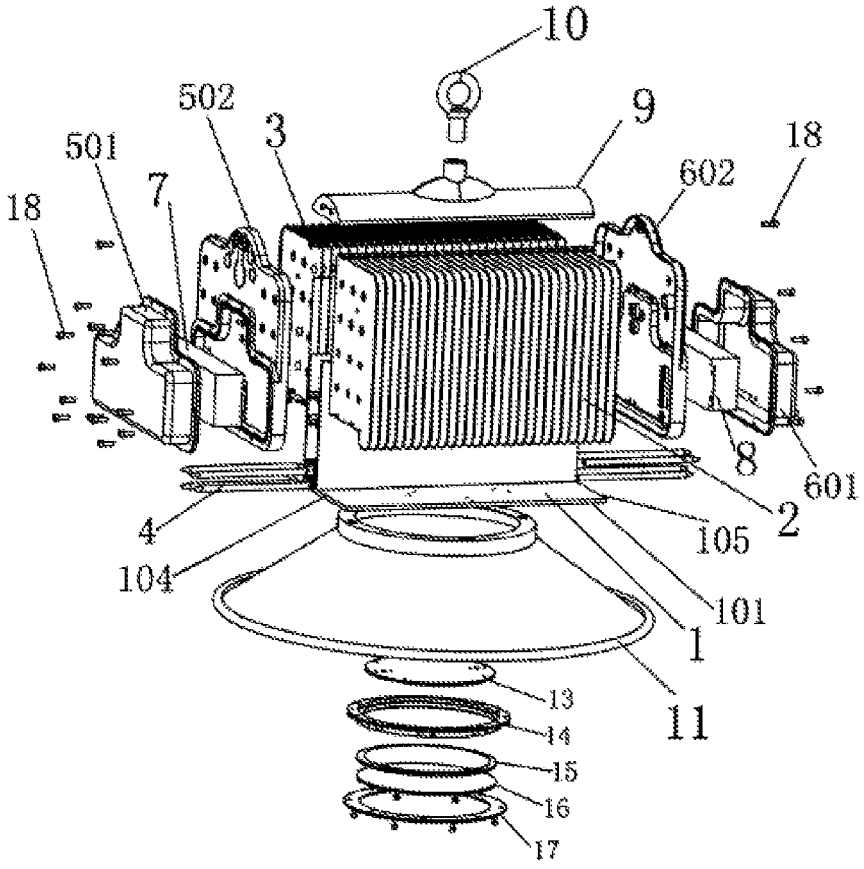
FIG. 13 is an exploded schematic view of the LED energy-saving lamp in FIG. 12.
Figure 14:
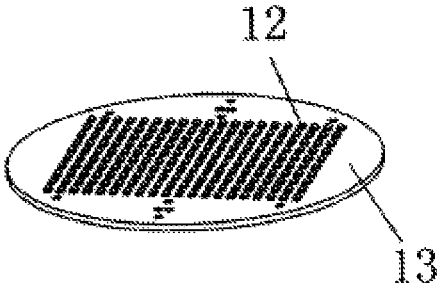
FIG. 14 is a schematic view of the LED lamp and a PCB board.
Figure 15:
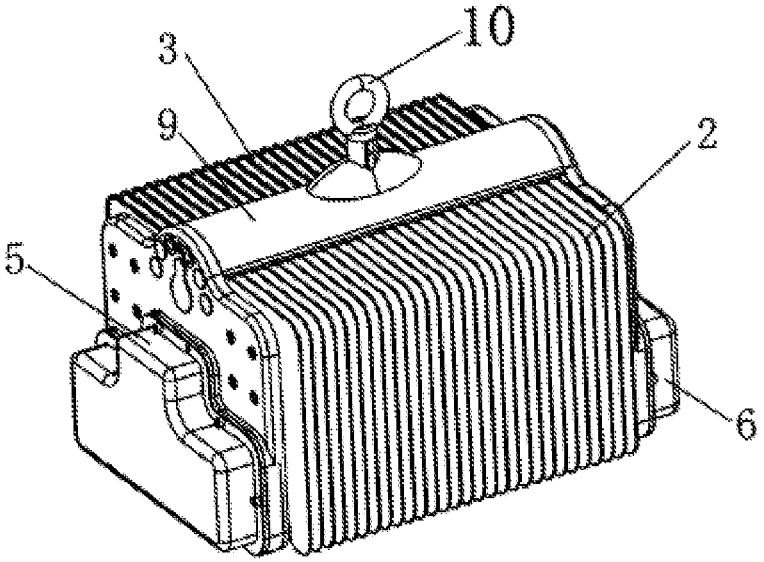
FIG. 15 is a schematic view of a second embodiment of the LED energy-saving lamp according to the present invention.
Figure 16:
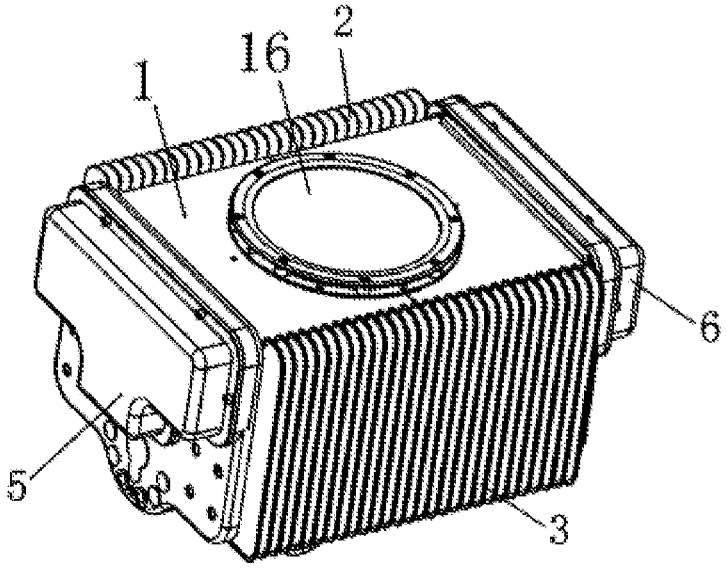
FIG. 16 is another schematic view of FIG. 15.
Figure 17:
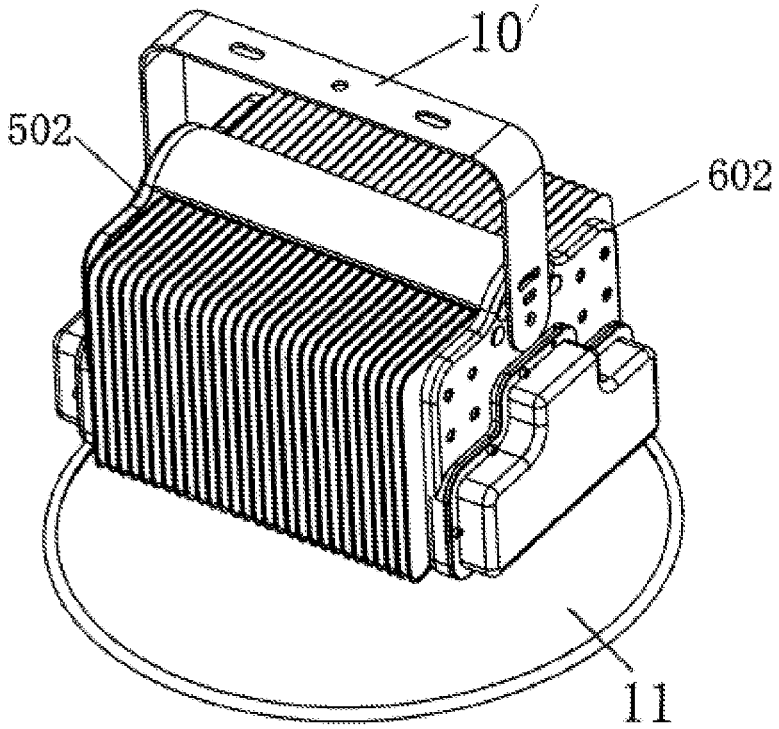
FIG. 17 is a schematic view of a third embodiment of the LED energy-saving lamp according to the present invention.
Figure 18:
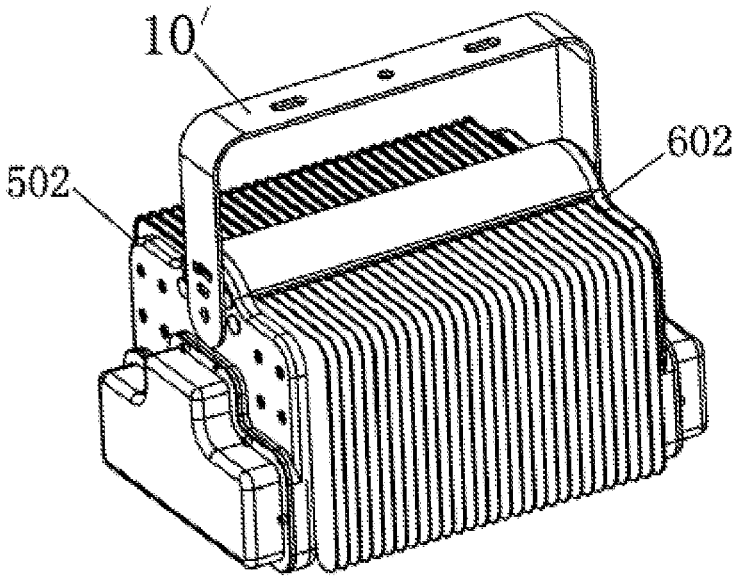
FIG. 18 is a schematic view of a fourth embodiment of the LED energy-saving lamp according to the present invention.
Figure 19:
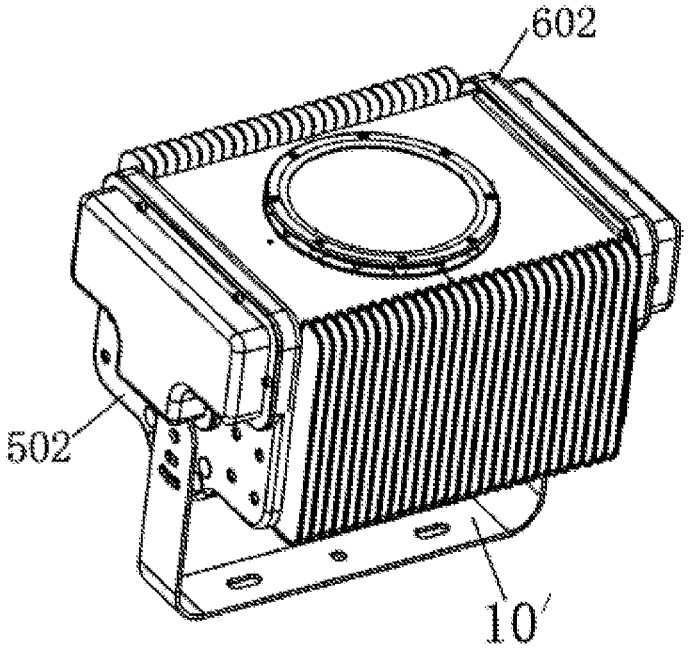
FIG. 19 is another schematic view of FIG. 18.

The LED energy-saving lamp further includes a top plate 9, a hook 10, a lamp shade 11, an LED lamp 12, a PCB board 13, a waterproof ring 14, a silica gel ring 15, a glass shade 16, and a pressing ring 17. The power supplies 7 and 8 are respectively installed in the power supply boxes 5 and 6. Upper covers 501 and 601 of the power supply boxes are respectively fixed on bottom covers 502 and 602 of the power supply boxes through fastening pieces 18. The top plate 9 is fixed between the two power supply boxes 5 and 6 through the fastening pieces 18. The hook 10 is fixed on the top plate 9 (as shown in FIG. 12 and FIG. 13) or the hook 10 is fixed on the bottom covers 502 and 602 of the power supply boxes (as shown in FIG. 17). In this way, the upper covers 501 and 601 of the power supply boxes can be conveniently opened, and the power supplies can still be conveniently changed after the energy-saving lamp is completely installed. The LED lamp 12 is distributed on the PCB board 13. The PCB board 13 is fixed on the base plate 101 of the heat conducting plate 1 through the fastening piece. Heat conducting paste (not shown in the Figs.) may be coated between the PCB board 13 and the base plate 101, which can quicken the heat dissipation. The waterproof ring 14 is covered on the PCB 13 and fixed on the base plate 101; the silica gel ring 15 is disposed on the waterproof ring 14; the glass shade 16 presses the silica gel ring 15; the pressing ring 17 presses the glass shade 16 and is fixed on the waterproof ring 14 to realize the waterproof function. The lamp shade 11 is covered on the pressing ring 17 and fixed on the base plate 101. Alternatively, the lamp shade 11 may also be omitted, as shown in FIGS. 15, 16, 18 and 19.

The foregoing LED energy-saving lamp may be designed and used as a high bay light, a flood light, an LED spot light, and the like, and installed according to the above connecting relationship while installation, which is very convenient.

When the lamp radiator and the energy-saving lamp according to the present invention are used, the heat is dissipated upwards through the lamp radiator, which implements excellent ventilation, less heats the power supplies at the left and right sides, and may prolong the service life of the power supplies. Moreover, the length of the fin group for heat dissipation may be changed according to the power of the energy-saving lamp, and may be designed flexibly, and lamp radiators with different sizes may be manufactured by increasing or decreasing the number of the fins. Fin groups having different lengths may be produced using one set of moulds only, which does not need to increase moulds, thus reducing the cost. The lamp radiator and the LED energy-saving lamp according to the present invention may quicken the heat dissipation and have excellent heat dissipation performances through such design as the heat conducting plate, the fin group for heat dissipation, the heat pipe, and the like.

The foregoing description is merely preferred embodiments of the present invention, but is not intended to limit the present invention. It should be pointed out that any modification, equivalent replacement or improvement and the like made by those skilled in the art within the spirits and principles of the present invention shall all fall within the protection scope of the present invention.

The invention claimed is:

1. A lamp radiator comprising:

a heat conducting plate having a base plate and two leg plates, the base plate having a length in a first direction and a width in a second direction that is perpendicular to the first direction, the two leg plates extending in parallel in the first direction and projecting from the base plate in a third direction perpendicular to the first and second directions;

a fin group for heat dissipation being fixed to the base plate and at least one of the two leg plates; and power supply boxes each equipped with a power supply being fixed at respective sides of the heat conducting plate in the first direction, wherein the fin group includes a first fin set and a second fin set each including a plurality of fins extending in parallel in a plane formed by the second direction and the third direction, wherein the plurality of fins of the first fin set and the plurality of fins of the second fin set extend away from each other from the two leg plates, wherein the two leg plates are positioned between the first and second fin sets, and wherein the lamp radiator further comprises a heat pipe, and the internal sides of the two leg plates of the heat conducting plate are respectively provided with N raised grooves, wherein the inner walls of M raised grooves of each leg plate of the heat conducting plate are tightly contacted with the heat pipe; M is less than N, and M and N are natural numbers.

2. The lamp radiator according to claim 1, wherein the cross section of the heat conducting plate is Π-shaped.

3. An LED energy-saving lamp, comprising:

the lamp radiator according to claim 1 wherein the power supply boxes are respectively fixed at the left side and the right side of the heat conducting plate and equipped with the power supplies; and an LED lamp attached to the lamp radiator.

4. The lamp radiator according to claim 2, wherein the length of the fin group for heat dissipation is changed according to the power of an energy-saving lamp.

5. The lamp radiator according to claim 4, wherein the plurality of fins of the fin group is composed of X fins in a fastening manner, wherein X is no less than 3 and is a natural number; a bending platform is respectively arranged on a length direction and a width direction of the fin, and the fin group for heat dissipation composed in a fastening manner forms a bending plane respectively on the length direction and the width direction of the fin.

6. The lamp radiator according to claim 5, wherein the bending planes of each of the first and second fin sets for heat dissipation are welded and fixed on the external sides of the leg plates and the base plate of the heat conducting plate.

7. The lamp radiator according to claim 6, wherein the heat pipe is hollow; and the heat pipe is connected with the inner walls of the raised grooves via welding or interference fit.

8. The lamp radiator according to claim 7, wherein each of the M raised grooves is equipped with two heat pipes, wherein one end of one heat pipe is located at one end of the raised groove and the other end of the heat pipe is located close to the neutral position of the raised groove; one end of the other heat pipe is located at the other end of the raised groove, and the other end of the heat pipe is located close to the neutral position of the raised groove.

9. The lamp radiator according to claim 8, wherein the power supply boxes equipped with the power supplies are fixed at the left side and the right side of the heat conducting plate through fastening pieces and the raised grooves of the heat conducting plate, wherein the heat conducting plate is made of aluminum or copper, and the heat pipe is made of copper or aluminum or stainless steel.

* * * * *